US006474292B1

(12) United States Patent
Frenz et al.

(10) Patent No.: US 6,474,292 B1
(45) Date of Patent: Nov. 5, 2002

(54) SYSTEM FOR OPERATING AN INTERNAL COMBUSTION ENGINE, ESPECIALLY AN INTERNAL COMBUSTION ENGINE OF AN AUTOMOBILE

(75) Inventors: Thomas Frenz, Noerdlingen (DE); Hansjoerg Bochum, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/914,357

(22) PCT Filed: Sep. 10, 1999

(86) PCT No.: PCT/DE99/02958

§ 371 (c)(1),
(2), (4) Date: Jan. 25, 2002

(87) PCT Pub. No.: WO00/52319

PCT Pub. Date: Sep. 8, 2000

(30) Foreign Application Priority Data

Feb. 26, 1999 (DE) ..... 199 08 352

(51) Int. Cl.[7] ..... F02M 37/04
(52) U.S. Cl. ..... 123/198 D; 123/497
(58) Field of Search ..... 123/495, 497, 123/359, 198 D

(56) References Cited

U.S. PATENT DOCUMENTS 4,790,277 A * 12/1988 Schechter ..... 123/357
5,241,933 A * 9/1993 Morikawa ..... 123/198 D
5,783,990 A * 7/1998 Dambach ..... 701/108
5,797,375 A * 8/1998 Dratt ..... 123/497
6,053,147 A * 4/2000 Hemmerlein et al. ..... 123/447
6,085,132 A * 7/2000 Ishii et al. ..... 701/102
6,234,148 B1 * 5/2001 Hartke et al. ..... 123/447
6,293,251 B1 * 9/2001 Hemmerlein et al. ..... 73/119 A

FOREIGN PATENT DOCUMENTS

| | | | |
|---|---|---|---|
| DE | 196 26 689 | 11/1997 | |
| DE | 196 34 982 | 3/1998 | |
| EP | 0 860 600 | 8/1998 | |
| EP | 0 899 442 | * 3/1999 | ..... F02D/41/22 |

* cited by examiner

*Primary Examiner*—Thomas N. Moulis
(74) *Attorney, Agent, or Firm*—Walter Ottesen

(57) ABSTRACT

Method for operating a fuel supply system of an internal combustion engine, especially of a motor vehicle, wherein fuel is pumped into a storage space (17) with the aid of a pump (12, 16) and a pressure is generated in the storage space (17). In the system, an actual value of the pressure is measured with the aid of a pressure sensor (21) and the pressure in the storage space (17) is controlled (open loop and/or closed loop) to a desired value. A fault in the fuel supply system (10) is detected via a plausibility control. When a fault in the fuel supply system (10) is detected, a diagnostic cycle of the internal combustion engine is initiated. Diagnostic functions are activated which check individual components (18, 19, 21) of the fuel supply system (10) as to operability.

9 Claims, 3 Drawing Sheets

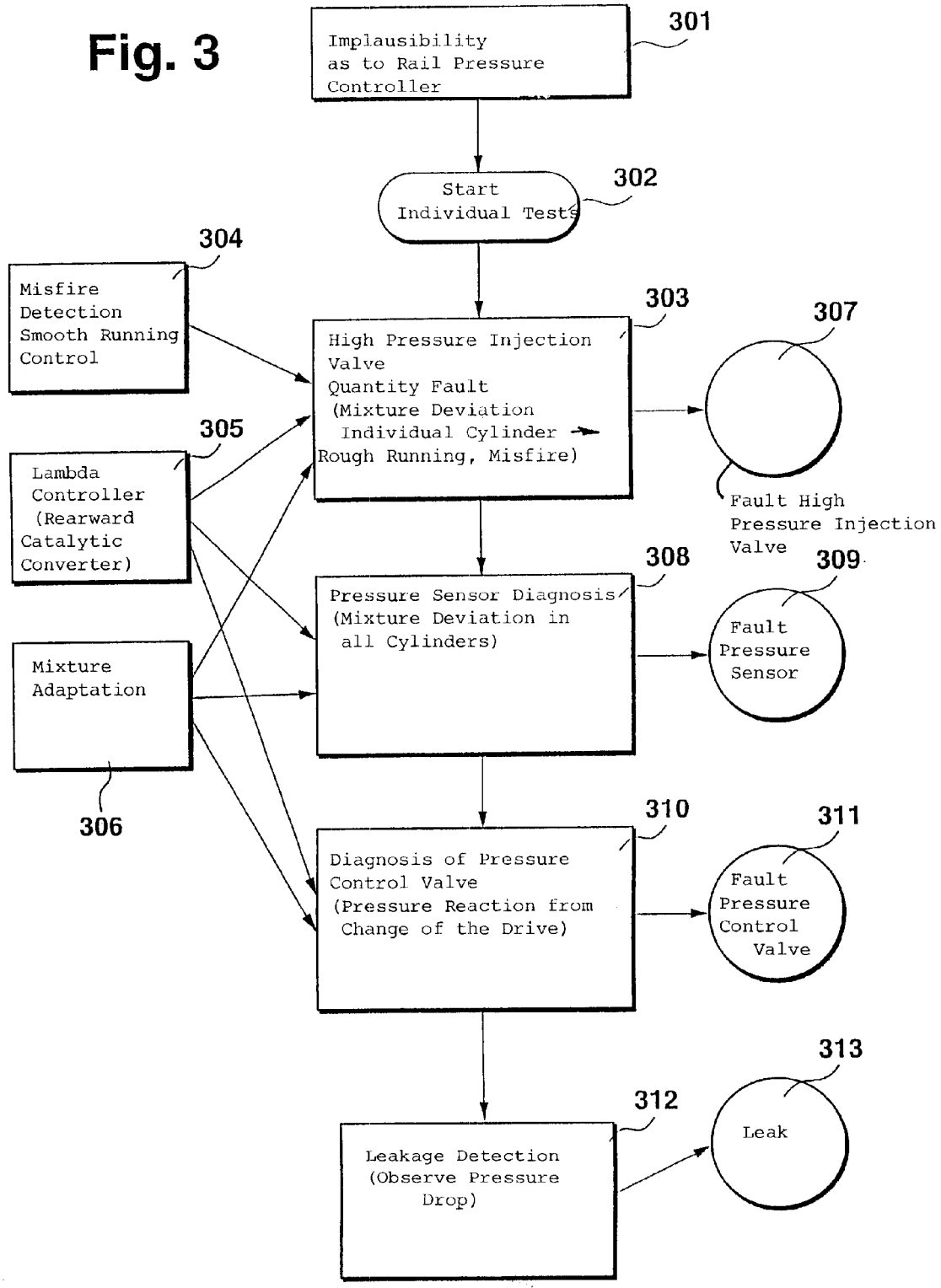
Fig. 3
Implausibility as to Rail Pressure Controller
301
Start Individual Tests
302
304
Misfire Detection Smooth Running Control
303
High Pressure Injection Valve Quantity Fault (Mixture Deviation Individual Cylinder Rough Running, Misfire)
307
Fault High Pressure Injection Valve
305
Lambda Controller (Rearward Catalytic Converter)
308
Pressure Sensor Diagnosis (Mixture Deviation in all Cylinders)
309
Fault Pressure Sensor
Mixture Adaptation
306
310
Diagnosis of Pressure Control Valve (Pressure Reaction from Change of the Drive)
311
Fault Pressure Control Valve
313
312
Leakage Detection (Observe Pressure Drop)
Leak

SYSTEM FOR OPERATING AN INTERNAL COMBUSTION ENGINE, ESPECIALLY AN INTERNAL COMBUSTION ENGINE OF AN AUTOMOBILE

FIELD OF THE INVENTION

The invention relates to a method and an arrangement for operating a fuel supply system of an internal combustion engine, especially of a motor vehicle. In the fuel supply system, fuel is pumped into a storage space with the aid of a pump and a pressure is generated in the storage space. In the fuel supply system, an actual value of the pressure is measured with the aid of a pressure sensor and the pressure in the storage space is controlled (open loop and/or closed loop) to a desired value. A fault in the fuel supply system is detected with a plausibility control.

BACKGROUND OF THE INVENTION

U.S. Pat. No. 5,241,933 discloses a fuel supply system wherein the fuel pressure is controlled with the aid of a pressure controller and wherein a fault detecting device detects a fault in the fuel supply system and this fault is displayed with the aid of a display device. For this purpose, a difference pressure is formed from an actual pressure and a desired pressure. A corrective value is then determined from the difference pressure and the desired value of the pressure is corrected with the corrective value.

The corrective value is additionally supplied to a fault detection device wherein a check is made as to whether the corrective value lies within a permissible pressure range formed by two predetermined values. If the corrective value lies outside of this range, then a fault in the fuel supply system is detected and displayed.

SUMMARY OF THE INVENTION

The present invention has the task of improving a method of the species type in such a manner that the component, which causes the fault in the fuel supply system, can be determined.

The especially significant advantage of the present invention is that a precise diagnosis of the fuel supply system is achieved without additional components.

BRIEF DESCRIPTION OF THE DRAWINGS

The invention will now be described with respect to the drawings wherein.

Embodiments of the invention are illustrated in the drawing and are explained in greater detail in the following description.

DESCRIPTION OF THE PREFERRED EMBODIMENTS OF THE INVENTION

Figure 1:
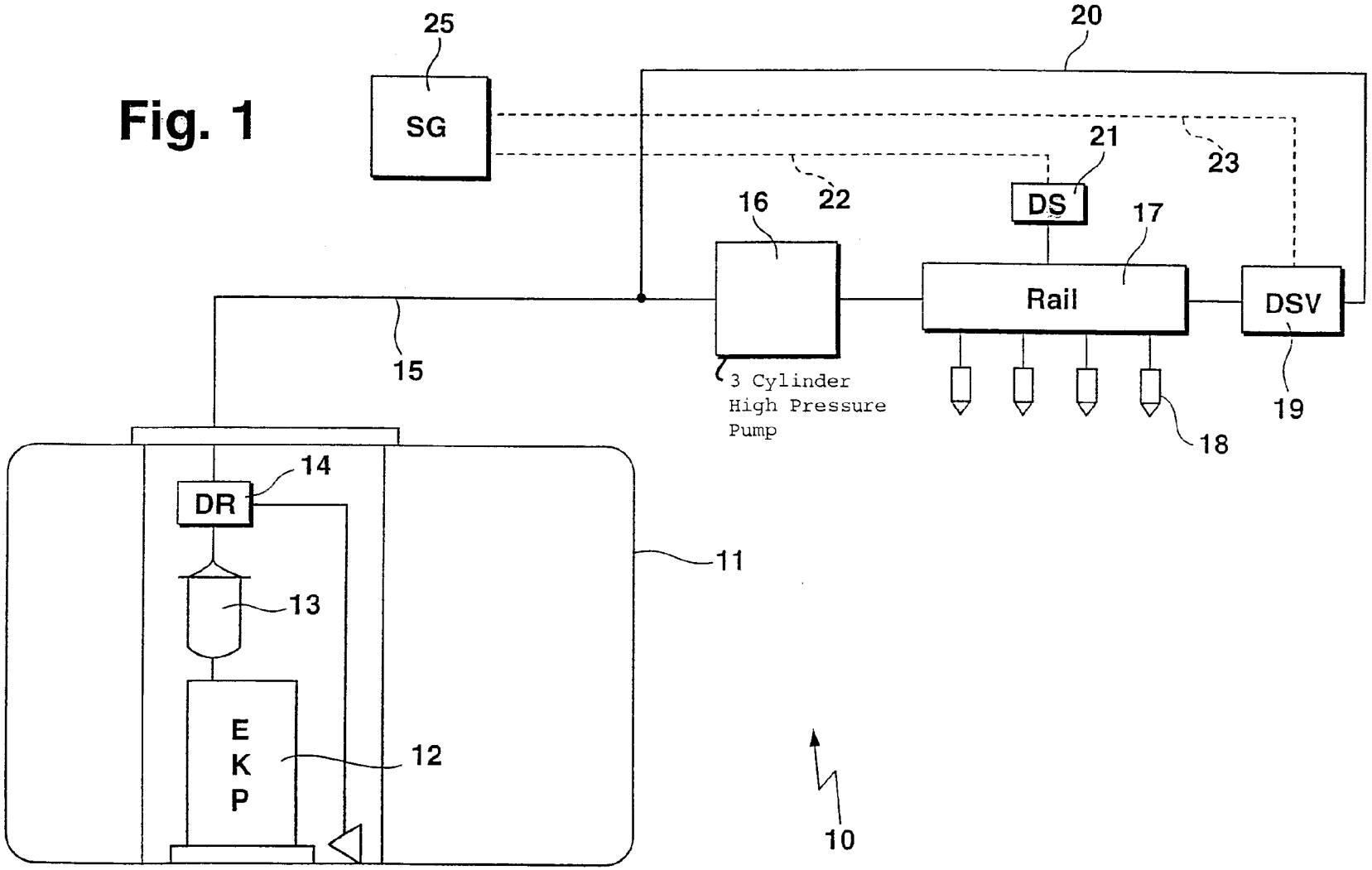
FIG. 1 schematically shows an illustration of a fuel supply system of an internal combustion engine.

In FIG. 1, a fuel supply system 10 is shown which is provided for the use in an internal combustion engine.

The following are mounted in a fuel tank 11: an electric fuel pump (EKP) 12, a fuel filter 13 and a low pressure controller 14.

The EKP 12 pumps the fuel via the fuel filter 13 from the fuel tank 11. The fuel filter 13 has the task of filtering out foreign particles from the fuel. The fuel pressure in the low pressure is controlled to a specific value with the aid of the low pressure controller 14.

A fuel line 15 leads from the fuel tank 11 to a high pressure pump 16. A storage space 17 is connected to the high pressure pump 16 and injection valves 18 are arranged on the storage space 17. The injection valves 18 are connected to the storage space 17 and are assigned preferably directly to the combustion chambers of the internal combustion engine.

The fuel is pumped from the fuel tank 11 with the aid of the electric fuel pump 12 via the fuel line 15 to the high pressure pump 16. In this process, the fuel is brought to a pressure of approximately 4 to 5 bar. The high pressure pump 16 is preferably driven directly by the engine and compresses the fuel and pumps the same into the storage space 17. The fuel pressure reaches a value of up to 120 bar. The injection valves 18 can be individually driven and the fuel is injected directly into the combustion chambers of the engine via these valves.

A pressure sensor 21 and a pressure control valve 19 are connected directly to the storage space 17. The pressure control valve 19 is connected at its input end to the storage space 17. At the output end, a feedback line 20 leads to the fuel line 15. The pressure sensor 21 and the pressure control valve 19 are connected to the control apparatus 25 via signal line 22 and control line 23.

In lieu of a pressure control valve 19, a quantity control valve can be utilized in a fuel supply system 10. For the sake of simplicity, only the pressure control valve 19 is described further in the material which follows.

The actual value of the fuel pressure in the storage space 17 is detected with the aid of the pressure sensor 21. The actual value is supplied to the control apparatus 25 via the signal line 22. In the control apparatus 25, a drive signal is formed on the basis of the detected actual value of the fuel pressure and, with this drive signal, the pressure control valve 19 is driven via the control line 23.

In the control apparatus 25, various functions are implemented which serve to control the engine. In modern control apparatus, these functions are programmed on a computer and then stored in a memory of the control apparatus 25. The functions, which are stored in the memory, are activated in dependence upon the demands made on the engine. In this connection, especially difficult requirements are imposed on the real time capability of the control apparatus 25 in combination with the functions. In principle, however, a pure hardware realization of the functions for controlling the engine is possible.

For example, the functions pressure control and pressure precontrol serve to control (open loop and/or closed loop) the pressure in the storage space 17 of the fuel supply system 10.

The function "pressure control" controls out disturbances which change the pressure in the storage space for short time spans. For this purpose, the output signal of the pressure sensor 21 is compared to a desired quantity. A signal is generated when detecting a deviation between output signal of the pressure sensor 21 and desired value and the pressure control valve 19 is driven with this signal and the deviation is corrected. In the normal case, that is, when no disturbance is present, the output of the pressure controller remains in the zero or neutral position.

The pressure precontrol generates a drive signal for the pressure control valve 19 on the basis of a desired quantity for the pressure. In general, the pressure precontrol defines the performance of the fuel supply system 10 so precisely that the pressure controller need only control out disturbances and otherwise remains in the neutral position.

The pressure control and the pressure precontrol operate, in principle, in parallel. The pressure control influences the dynamic performance of the pressure in the storage space and the pressure precontrol influences the steady state of the pressure in the storage space.

Figure 2:
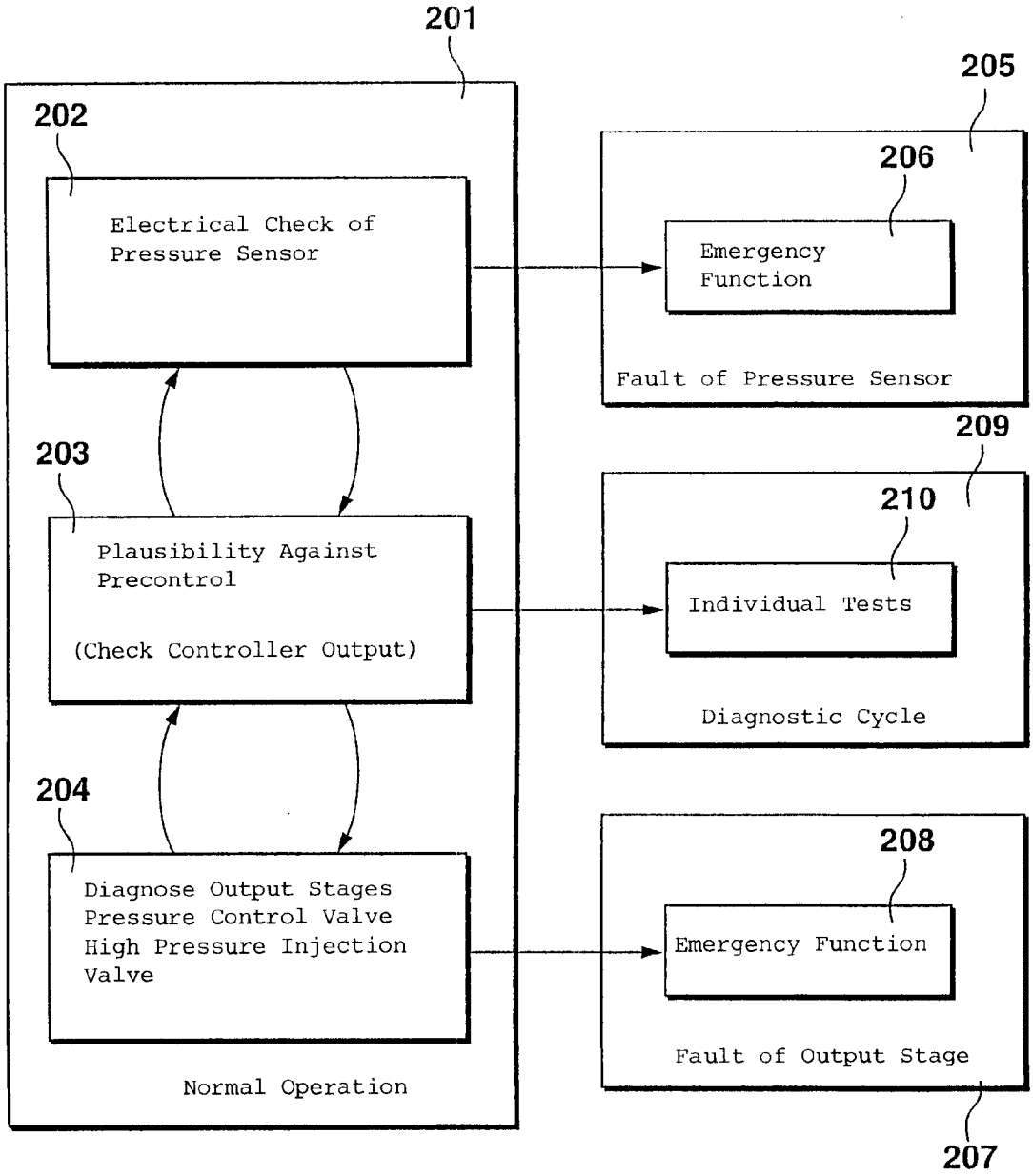
FIG. 2 schematically shows the sequence of the diagnosis of the fuel supply system; and, FIG. 3 schematically shows the sequence of the diagnostic cycle when detecting a fault in the fuel supply system.

The sequence of a diagnosis of the fuel supply system 10 is shown in FIG. 2.

A block 201 represents the normal operation of the internal combustion engine. Normal operation means that the engine operates free of fault, no emergency functions are activated and/or the diagnostic cycle is not activated.

Various checks are continuously carried out during the normal operation 201 of the engine. In block 202, an electric check of the pressure sensor 21 is carried out. At the same time, a general plausibility control of the fuel supply system is carried out in block 203 and the end stages of the pressure control valve 19 and of the high pressure injection valves 18 are checked in block 204.

The electric check of the pressure sensor 21 is executed by evaluating the output signal of the pressure sensor 21. For this purpose, a check, for example, is made as to whether the output signal assumes values within a permissible range. If the output signal assumes values outside of the permissible range, then a short circuit fault or a cable break fault is detected. Furthermore, a check can be made as to whether the time-dependent trace of the output signal exhibits a typical form in dependence upon the fuel supply system 10.

If a fault of the pressure sensor 21 is detected in block 202, then, in block 205, the fault is displayed with the aid of a display device and, at the same time, a corresponding emergency operation of the engine is adjusted in block 206. For example, the pressure control is switched off in the emergency operation when detecting a fault of the pressure sensor 21 so that the pressure in the storage space 17 is adjusted only by the pressure precontrol.

A fault of the output stages of the pressure control valve 19 or of the high pressure injection valves 18 is detected by observing an output stage voltage of the individual output stages. If the output stage voltage in the switched-on or switched-out state of the output stages deviates significantly from a value, which is predetermined for the switched-on or switched-off state of the output stages, then a short circuit fault or cable break fault is detected in the output stages.

If a fault of the output stages of the pressure control valve 19 or of the high pressure injection valves 18 is detected in block 204, then, in block 207, the fault is displayed with the aid of a display device and, simultaneously, a corresponding emergency operation of the engine is adjusted in block 208.

If a general fault is detected in block 203 via a plausibility control of the fuel supply system 10, then, in block 209, the fault is displayed with the aid of a display device and a diagnostic cycle of the engine is started and displayed. For this purpose, various diagnostic functions are activated in block 210 which serve to check the individual components of the fuel supply system 10.

For example, a plausibility control of the fuel supply system 10 is carried out (wherein, in addition to the pressure controller, also the pressure precontrol is active for controlling pressure in the storage space 17) in that the output value of the pressure controller is compared to a predetermined threshold value. If the output value of the pressure controller exceeds the threshold value over a predetermined time span, then a deviation of the fuel supply system 10 from the normal performance or from the pressure control is detected. For this purpose, it is a condition precedent that the pressure precontrol functions properly and defines the steady state performance of the fuel supply system 10 with adequate accuracy.

FIG. 3 schematically shows the sequence of the diagnostic cycle.

Step 301 corresponds to step 203 of FIG. 2. If a fault is detected in the fuel supply system 10 in step 301 via the plausibility control, then the diagnostic cycle is started in step 302. Here, diagnostic functions are activated which check the individual components of the fuel supply system 10 as to operability.

For this purpose, output signals of the functions "misfire detection", "smooth running control", "lambda control", "mixture adaptation" or "leakage detection" are evaluated in a suitable manner and logically coupled to each other.

In the following, signals are also identified as output signals which can originate from an intermediate result of the above-mentioned functions.

With the aid of the function "misfire detection" shown in block 304, combustion misfires are detected on the basis of an air/fuel ratio which is too rich or too lean. Combustion misfires in individual cylinders effect that the individual cylinders no longer output the same torque whereby a rough running of the engine takes place.

With the aid of the function "smooth running control" shown in block 304, different outputted torques are detected in the individual cylinders and compensated by a variation of the injected fuel mass in the affected cylinders.

With the aid of the function "lambda control" shown in block 305, it is detected by evaluating a signal of a lambda probe as to whether the air/fuel ratio, which is predetermined by a desired value, was actually present in the combustion chamber and was there combusted. If a deviation between the desired value and the detected value of the air/fuel ratio is detected, a corrective signal is generated and is supplied to a function for mixture formation. Short-term deviations between the pregiven air/fuel ratio and the detected air/fuel ratio can be detected by evaluating the time-dependent trace of the corrective signal.

The lambda control can only then optimally control out control deviations when the controller output assumes a value close to the neutral position in the rest state (that is, there are no control deviations present). If continuous deviations or disturbances occur because of deterioration or a fault in the fuel supply system 10, then the controller output continuously assumes a value outside of the zero position and thereby runs outside of its optimal work range. Short-term deviations or disturbances can no longer be compensated or only poorly compensated.

The function "mixture adaptation" shown in block 304 solves this problem. The function detects continuous deviations between the pregiven air/fuel ratio and the detected air/fuel ratio by evaluating the output signal of the lambda control and intervenes adaptively in the mixture formation. For this purpose, the mass of the fuel to be injected is so changed that the controller output again assumes a value close to the zero position in the rest state.

In block 303, the function of the high pressure injection valves 18 is first checked. An electrical check of the output stages of the high pressure injection valves 18 already takes place during normal operation of the engine. For this reason, a check is made in the diagnostic cycle as to whether a quantity fault is present. A quantity fault is present when a predetermined fuel quantity is not coincident with the fuel quantity injected into the combustion chamber of the engine.

For this purpose, with the aid of the functions "misfire detection" and "smooth running control" shown in block 304, a determination is made from a comparison of the output signals of these functions with predetermined threshold values as to whether and in which cylinders rough running or combustion misfires are present. Already with this information, a conclusion can be drawn with high probability as to a fault of the high pressure injection valves 18.

In addition, an output signal of the lambda control, which is shown in block 305, is evaluated. For this purpose, a check is made as to whether the output signal of the lambda control is greater than a predetermined threshold value over a predetermined time. Alternatively, or in addition to the lambda control, the output signal of the mixture adaptation, which is shown in block 306, is evaluated. The output signal of the mixture adaptation is, as also for the lambda control, compared to a predetermined threshold value.

Short-term faults, that is, faults of the high pressure injection valves 18 which are present for a short time, are detected via an AND logic coupling of the results of the smooth running control or the misfire detection 304 with the result of the lambda control 305. Stated otherwise, if a fault is detected with the aid of the misfire detection or with the aid of the smooth running control and if, additionally, a fault is detected with the aid of the lambda control, then a conclusion is drawn as to a fault of the high pressure injection valves 18.

Permanent faults of the high pressure injection valves 18, that is, faults which are permanently present, are detected via an AND logic coupling of the results of the smooth running control or the misfire detection 304 to the result of the mixture adaptation 306. Stated otherwise, a fault is detected with the aid of the misfire detection or the smooth running control and, if additionally a fault is detected with the aid of the mixture adaptation 306, a conclusion is drawn as to a fault of the high pressure injection valves 18.

A fault of the high pressure injection valves 18 is displayed in block 307 with the aid of a display device.

If a fault of the high pressure injection valves 18 was detected, then the diagnostic cycle is ended and a corresponding emergency operation of the engine is set.

If no fault of the high pressure injection valves 18 is present, then a check of the pressure sensor 21 as to operability is made in block 308.

Fuel is supplied to the storage space 17 in the normal operation of the engine. The pressure in the storage space 17 is measured by the pressure sensor 21 and fuel is supplied via the high pressure injection valves 18 to a combustion. The performance of the combustion of the fuel can be detected by evaluating the output signals of the functions "lambda control" 305 and/or "mixture adaptation" 306.

For diagnosing the pressure sensor 21, the pressure in the storage space is detected at a predetermined time point with the pressure sensor 21 and the combustion performance of the fuel is detected with the aid of the lambda control and/or the mixture adaptation. The pressure in the pressure store is then changed. Thereafter, the pressure and the combustion performance of the fuel are again detected. A conclusion as to the functioning of the pressure sensor 21 is drawn from a comparison of the values for the pressure in the storage space 17 which are detected ahead of the pressure change and after the pressure change and the combustion performance of the fuel.

A fault of the pressure sensor 21 is indicated in block 309 with the aid of a display device. If a fault of the pressure sensor 21 was detected, then the diagnostic cycle is ended and a corresponding emergency operation of the engine is activated.

If no fault of the high pressure injection valves 18 or of the pressure sensor 21 is present, then, in block 310, the function of the control pressure valve 19 is checked. An electrical check of the output stages of the pressure control valve 19 already takes place during the normal operation of the engine. For this reason, a check is made here as to whether the pressure value, which is to be expected from a drive of the pressure control valve 19 via the control apparatus 25, is adjusted in the storage space 17.

For this purpose, the signal, which drives the pressure control valve 19, can, for example, be compared to the signal outputted by the pressure sensor 21. If these signals deviate significantly from each other over a longer time span, then a conclusion can be drawn therefrom as to a fault of the high pressure valve 19.

In order to be able to detect a fault of the pressure control valve 19 with greater certainty, the output signals of the lambda control 305 and of the mixture adaptation 306 are additionally evaluated. For example, the signal, which drives the pressure control valve 19, can be changed in a predetermined manner whereby the pressure in the storage space 17 and the injected fuel mass normally are changed in a targeted manner. At the same time, the performance of the combustion is detected via the evaluation of the output signals of the lambda control and the mixture adaptation. The signal, which drives the pressure control valve 19, is compared to the output signals of the lambda control and/or of the mixture adaptation. If the signal, which drives the pressure control valve 19, is changed rapidly in a predetermined manner, then the signal, which drives the pressure control valve 19, is compared to the output signal of the lambda control. If these signals deviated significantly from each other over a predetermined time span, then a conclusion can be drawn therefrom as to a fault of the pressure control valve 19. If the signal, which drives the pressure control valve 19, changes slowly in a predetermined manner, then the signal, which drives the pressure control valve 19, is compared to the output signal of the mixture adaptation 306. If these signals deviate significantly from each other over a predetermined time span, then a conclusion can be drawn therefrom as to a fault of the pressure control valve 19.

A fault of the sensor 21 is indicated in block 311 with the aid of a display device.

If neither a fault of the high pressure injection valves 18, of the pressure sensor 21 or of the pressure control valve 19 is present, a check is made in step 312 as to whether a leak is present in the fuel supply system 10.

For this purpose, in the after running of the engine (that is, the engine is switched off), the pressure decay in the storage space 17 is detected. If the pressure drops off in a shorter time span than a predetermined time span, then a leakage of the fuel supply system 10 is detected.

A leakage of the fuel supply system 10 is displayed in a block 313 with the aid of a display device.

The sequence of the check of the individual components of the fuel supply system 10 was taken here only as exemplary and can be changed in any suitable manner. Logically, the diagnosis of the pressure sensor 21 should always take place ahead of the diagnosis of the pressure control valve 19 when the diagnosis of the pressure control valve 19 has as a condition precedent an operating pressure sensor 21.

Furthermore, additional components of the fuel supply system 10 can be checked in the diagnostic cycle in addition to the components described herein as exemplary.

What is claimed is:

1. A method for operating a fuel supply system of an internal combustion engine including an engine of a motor vehicle, the method comprising the steps of:

pumping fuel into a storage space with the aid of a pump and generating a pressure in the storage space;

measuring an actual value of the pressure with the aid of a pressure sensor;

controlling the pressure in the storage space (open loop and/or closed loop);

detecting a fault in the fuel supply system via a plausibility control;

initiating a diagnostic cycle of the engine when detecting a fault in the fuel supply system; and, activating diagnostic functions which check the individual components of the fuel supply system as to operability thereby determining the component which causes the fault and displaying the same.

2. The method of claim 1, wherein, for the plausibility control of the fuel supply system, the output signal of a function, which is realized in the control apparatus and generates signals for driving the pressure control valve to control the pressure in the storage space, is compared to a threshold value and a fault in the fuel supply system is detected when the threshold value is continuously exceeded.

3. The method of claim 1, wherein diagnostic functions are activated which check the following as to operability: at least a pressure sensor and/or a high pressure injection valve and/or a quantity control valve or pressure control valve and/or a housing or seals of the fuel supply system.

4. The method of claim 1, wherein, in addition to the plausibility control, the output signal of a pressure sensor and the output stages of a pressure or quality control valve are monitored and, when a fault is detected, the fault is displayed and a corresponding emergency function of the engine is activated.

5. The method of claim 1, wherein, the diagnostic cycle is ended and a corresponding emergency function of the engine is activated when a fault of a component of the fuel supply system is detected.

6. The method of claim 1, wherein, during the diagnostic cycle, a fault of a high pressure injection valve is detected by evaluating an output signal of at least: a misfire detection and/or a smooth running control and/or a lambda control and/or a mixture adaptation and this fault is indicated.

7. The method of claim 1, wherein, during the diagnostic cycle, a fault of a pressure sensor is detected via evaluation of an output signal of at least a lambda control and/or a mixture adaptation and this fault is indicated.

8. The method of claim 1, wherein, during the diagnostic cycle, a fault of a pressure control valve or quantity control valve is detected via evaluation of an output signal of at least: a pressure sensor and/or a lambda control and/or a mixture adaptation and this fault is displayed.

9. An electrical storage medium including a read-only-memory, for a control apparatus of an internal combustion engine including an engine of a motor vehicle, the electrical storage medium comprising: a program stored thereon which can, when executed on a computing apparatus including on a microprocessor, execute the method for operating a fuel supply system of an internal combustion engine including an engine of a motor vehicle, the method including the steps of: pumping fuel into a storage space with the aid of a pump and generating a pressure in the storage space; measuring an actual value of the pressure with the aid of a pressure sensor; controlling the pressure in the storage space (open loop and/or closed loop); detecting a fault in the fuel supply system via a plausibility control; initiating a diagnostic cycle of the engine when detecting a fault in the fuel supply system; and, activating diagnostic functions which check the individual components of the fuel supply system as to operability thereby determining the component which causes the fault and displaying the same.

* * * * *